US007276671B1

(12) United States Patent
Wu

(10) Patent No.: US 7,276,671 B1
(45) Date of Patent: Oct. 2, 2007

(54) ELECTRONIC DEVICE HAVING A MODULARIZED PRESS KEY

(75) Inventor: Yaz-Tzung Wu, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 11/394,237

(22) Filed: Mar. 31, 2006

(51) Int. Cl.
*H01H 13/14* (2006.01)

(52) U.S. Cl. ..... 200/520; 200/341

(58) Field of Classification Search ..... 200/516–521, 200/313, 314, 341–345
See application file for complete search history.

(56) References Cited

U.S. PATENT DOCUMENTS 5,145,058 A * 9/1992 Lee ..... 200/517
5,597,067 A * 1/1997 Yoneyama ..... 200/344
5,697,493 A * 12/1997 Sach et al. ..... 200/314
5,990,435 A * 11/1999 Chao ..... 200/517
6,498,311 B1 * 12/2002 Stewart et al. ..... 200/313

* cited by examiner

*Primary Examiner*—Elvin Enad
*Assistant Examiner*—Lisa Klaus
(74) *Attorney, Agent, or Firm*—Reed Smith LLP; Stanley P. Fisher, Esq.; Juan Carlos A. Marquez, Esq.

(57) ABSTRACT

An electronic device having a modularized press key disposed therein. The electronic device is provided with a switch, and the modularized press key is composed of a key cap, an identification part, and an extension part. The key cap is provided with a connection hole and is disposed in the electronic device and facing the switch. The identification part is disposed in the connection hole, and the extension part has a specific color and is engaged to the identification part in a specific direction. The other end of the extension part is pressed against the switch. As such, through the uniqueness of the assembly and the distinction of the colors, the fool-proof assembly and fault inspection and detection of the modularized press key are achieved.

11 Claims, 5 Drawing Sheets

ELECTRONIC DEVICE HAVING A MODULARIZED PRESS KEY

BACKGROUND

1. Field of Invention

The invention relates to a press key structure and an electronic device utilizing such a press key structure, and in particular to a modularized press key having a common structure and an electronic device having such a modularized press key.

2. Related Art

In general, all kinds of electronic devices are provided with press keys to be utilized for data input purpose. However, their designs can be varied depending on the actual requirements. As such, different types of press keys must be designed and manufactured to be used in different products/devices. However, currently such kinds of press keys are made by the injection molding method. Therefore, a unique mold of press keys is required for each of the different products. For the structures of the press keys to be assembled on two different electronic products, refer to FIGS. 1A and 1B. As shown in FIGS. 1A and 1B, the press keys of the two products are provided with the key cap 100 of the same shape, however, their respective top blocks 110 have different lengths. Since the key cap 100 and the top block 110 are produced utilizing the injection molding method, as such, the key caps 100 used for the two different press keys are the same, yet the lengths of the respective top blocks 110 are different, thus two different molds are required. Therefore, it is quite uneconomical due to the high production cost of mold.

SUMMARY OF THE INVENTION

In view of the above-mentioned drawbacks and shortcomings of the prior art, the object of the invention is to provide an electronic device having a modularized press key, which can be produced to reduce the production cost and mounted on the electronic devices of different assembly requirements by making use of a common structure and color differentiation. In addition, it can be used to reduce the assembly errors through the unique type of assembly to ensure correct and accurate assembly. Moreover, color distinction/differentiation are used to facilitate the inspection and detection of error.

Therefore, to achieve the above-mentioned objects, the invention discloses an electronic device having a modularized press key, which is mounted on the electronic device with a switch. The modularized press key is composed of a key cap, an identification part, and an extension part. In the key cap, a connection hole is provided, thus the key cap is disposed in the electronic device and opposite to the switch. The identification part is disposed in the connection hole, and the extension part of specific color is engaged to the identification part in a specific direction, hereby making the extension part pressed against the switch. Thus, the extension parts with different lengths and colors and the different matched identification parts can be utilized for the key cap and the switch of different spacing.

In order to provide a unique assembly feature for the identification part and the extension part, a recess slot is provided on the side of the identification part engaging the extension part, and a protrusion block is provided on the side of the extension part facing the identification part. The protrusion block is designed to match the recess slot, so that the extension part may engage the identification part in a specific direction.

In the press key structure, the identification part and the extension part are of the same color. Thus, if they are replaced by different types of identification parts and extension parts, their respective colors are also changed, so as to provide color distinction/differentiation between them.

Therefore, through the application of the modularized press key having the common structure, the color distinction between the elements may be utilized to provide the foolproof and fault detection in facilitating the assembly and inspection of the press key depending on the actual requirements of the electronic product.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow for illustration only, and thus are not limitative of the present invention, and wherein.

DETAILED DESCRIPTION OF THE INVENTION

The purpose, construction, features, and functions of the invention can be appreciated and understood more thoroughly through the following detailed description with reference to the attached drawings.

Figure 4A:
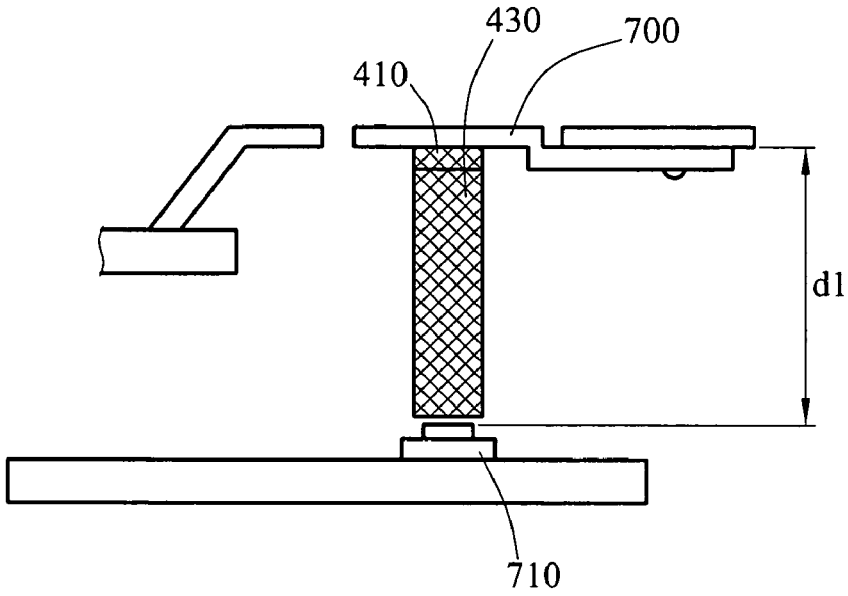
FIGS. 4A and 4B are schematic diagrams indicating the assembly of a press key into an electronic device according to an embodiment of the invention.
Figure 4B:
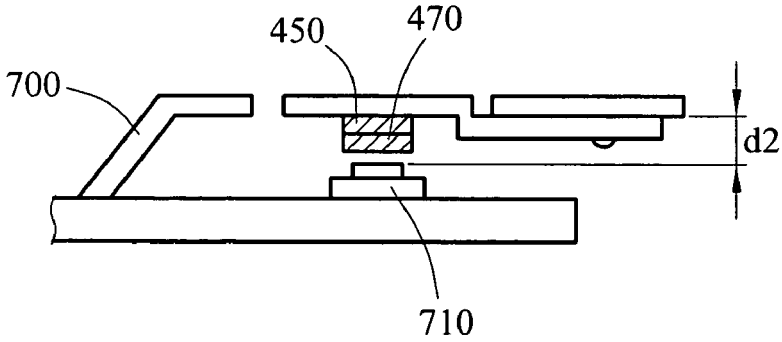

Firstly, refer to FIGS. 4A and 4B for the schematic diagrams of the press key structures utilized in an electronic device according to an embodiment of the invention. The invention relates to an electronic device having a modularized press key, thus the modularized press key 300 is disposed inside the electronic device 700. Usually, in the same series of electronic devices 700, the same type of components are utilized to reduce production cost, thus the press key 300 is one of such components. However, since the structure features of different types of electronic devices 700 may vary, such as their sizes and thicknesses. Thus, for instance, if the thickness of the electronic device 700 is changed, then the types of press key 300 installed thereon must change accordingly. As such, the press key of the invention may be applied on various kinds of electronic devices by making use of the modular concept.

Figure 1A:
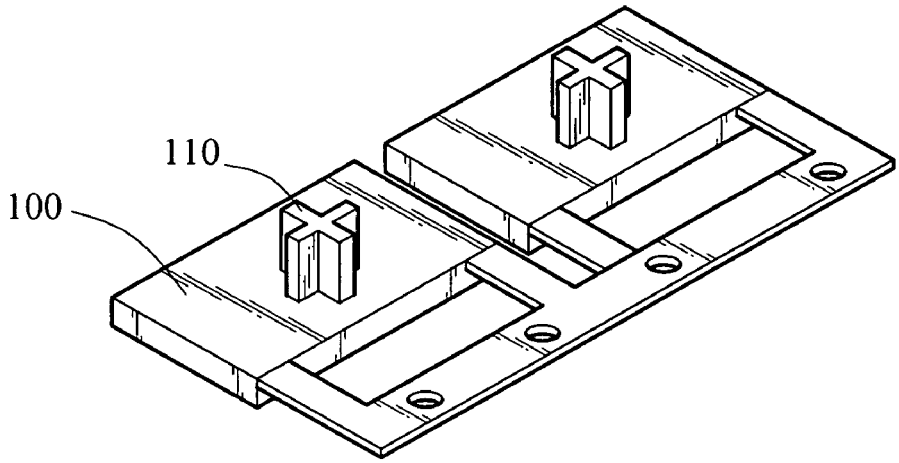
FIG.1A (RELATED ART)
FIGS. 1A and 1B are schematic diagrams of the structure of a press key assembly of the prior art.
Figure 1B:
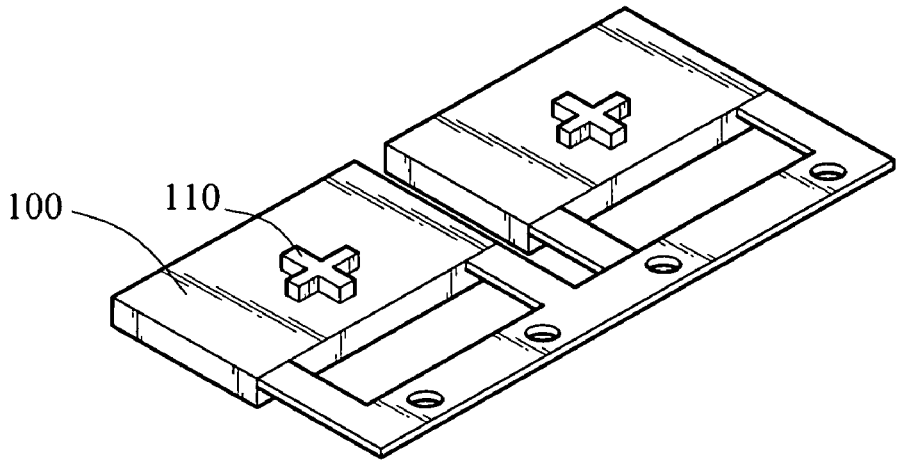
FIG.1B (RELATED ART)
Figure 2:
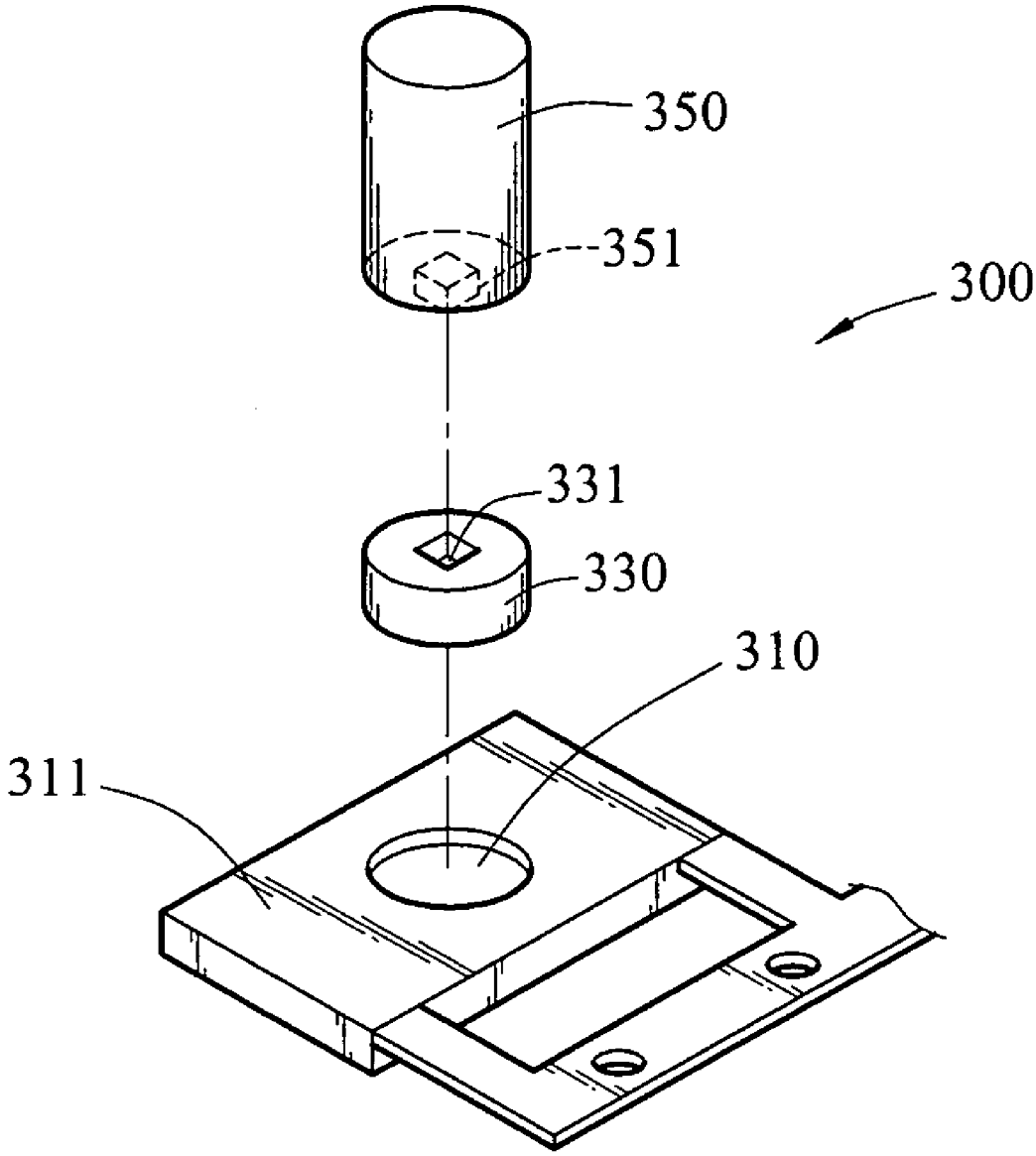
FIG. 2 is an exploded view of a press key structure according to the invention.

Next, refer to FIGS. 2, 4A and 4B for an exploded view of a press key structure and the schematic diagrams of the press key structures utilized in an electronic device according to the invention. As shown in FIG. 2, a press key 300 includes a key cap 310, an identification part 330, and an extension part 350. The key cap 310 is configured in the electronic device 700, and in a position corresponding to the switch 710 of the electronic device 700, and a connection hole 311 is provided on the side of the key cap 310 facing the switch 710. The identification part 330 is configured in the connection hole 311, one end of the extension part 350 is connected to the identification part 330, and the other end of the extension part is pressed against the switch 710. Thus, when the key cap 310 is pressed, it pushes the identification part 330 and the extension part 350 to press against the switch 710, thus turning on the switch 710.

For the various electronic devices, the press key 300 utilized therein is provided with a fool-proof mechanism during assembly. Thus, the identification part 330 and the extension part 350 are required to have a unique combination, as such a recess slot 331 is provided on the side of the identification part 330 engaging the extension part 350, and also, the side of the extension part 350 corresponding to the identification part 330 is provided with a protrusion block 351. The protrusion block 351 is used to match the recess slot 331, so that the extension part 350 may engage the identification part 330 in a specific direction.

In the above-mentioned structure, the combination of the protrusion block 351 and the recess slot 331 may be a combination of a square block and a square slot, or a combination of a triangle block and a triangle slot, so that the extension part 350 having square protrusion block may only be connected to the identification part 330 having the square recess slot, hereby preventing mis-assembly. Besides, the identification of matching colors are utilized, so that different colors may be used to indicate the different combinations of extension part 350 and identification part 330, thus it may further reduce the occurrences of mis-assembly and hereby facilitate inspection and fault detection.

Figure 3A:
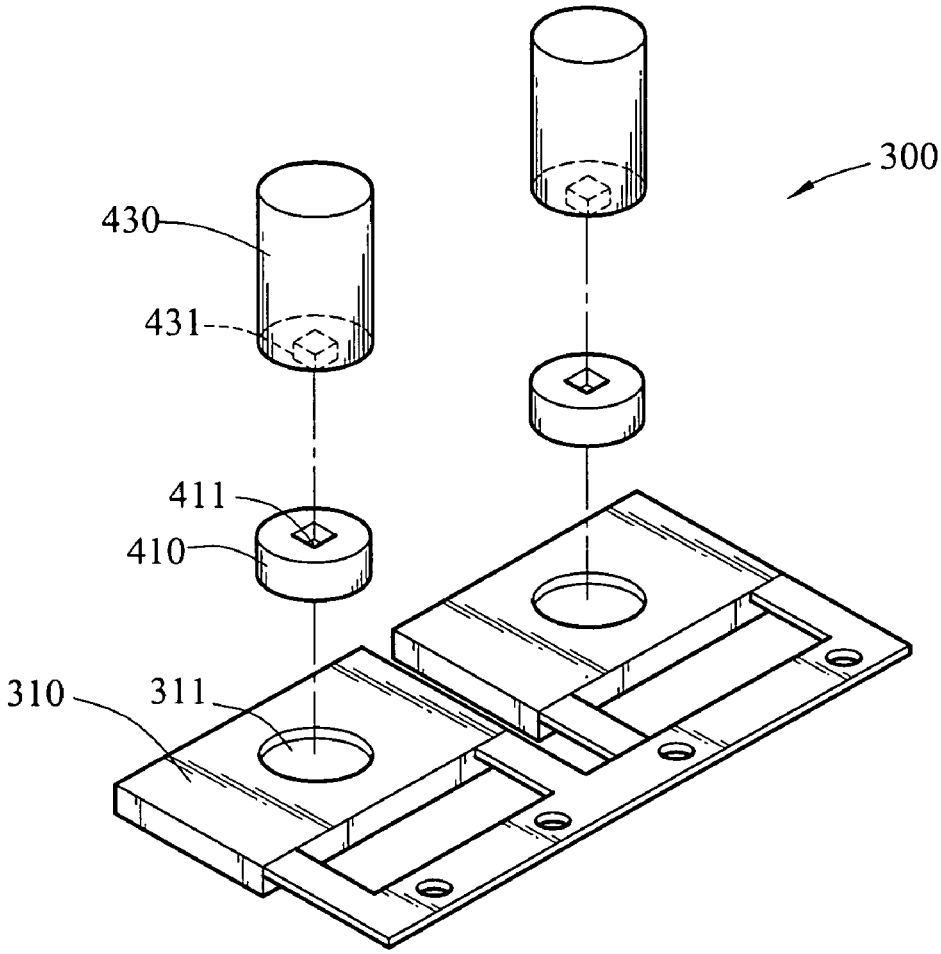
FIGS. 3A and 3B are exploded views of a press key structure according to an embodiment of the invention.
Figure 3B:
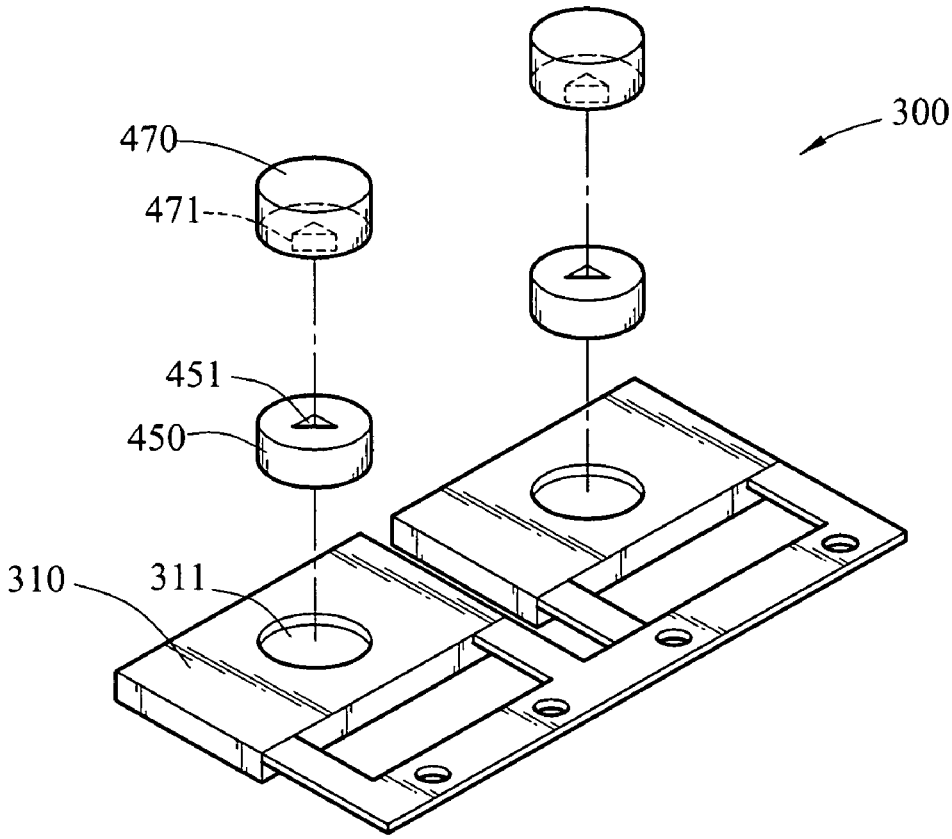

Subsequently, refer to FIGS. 3A, 3B, 4A and 4B for the exploded views of a press key structure and the schematic diagrams of the press key structures utilized in an electronic device according to an embodiment of the invention. As shown in FIGS. 3A and 3B, when the distance between the key cap 310 and switch 710 is varied, different combinations of the extension part and identification part are required. As such, when the spacing between the key cap 310 and the switch 710 is distance d1 as shown in FIG. 4A, then a key cap 310 is used to match the combination of a first identification part 410 and a first extension part 430; and when the spacing between the key cap 310 and the switch 710 is distance d2, then key cap 310 is used to match the combination of a second identification part 450 and a second extension part 470. As shown in FIG. 4B, in order to prevent the first identification part 410 from being connected to the second extension part 470, a unique combination is provided between the first identification part 410 and the first extension part 430. Similarly, in order to prevent the second identification part 450 from being connected to the first extension part 430, a unique combination is provided between the second identification part 450 and the second extension part 470. Therefore, a first recess slot 411 is provided on the side of the first identification part 410 engaging the first extension part 430, and a first protrusion block 431 is provided on the side of the first extension part 430 corresponding to the first identification part 410. The first protrusion block 431 is used to match the first recess slot 411, so that the first extension part 430 may engage the first identification part 410 in a specific direction. As such, the first recess slot 411 could be a square slot, and the first protrusion block 431 could be a square block, thus ensuring that the first extension part 430 may correctly and accurately engage the first identification part 410.

Moreover, a second recess slot 451 is provided on the side of the second identification part 450 engaging the second extension part 470, and a second protrusion block 471 is provided on the side of the second extension part 470 corresponding to the second identification part 450. The second protrusion block 471 is used to match the second recess slot 451, so that the second extension part 470 may engage the second identification part 450 in a specific direction. As such, the second protrusion block 471 could be a triangle block, and the second recess slot 451 could be a triangle slot, thus ensuring the second extension part 470 may correctly and accurately engage the second identification part 450.

In addition, the color matching identification may be used to ensure further the correct assembly of the press keys. For example, in the correct assembly the first extension part 430 and the first identification part 410 may be both of yellow color, while the second extension part 470 and the second identification part 450 may be both of red color. As such, during the assembly of the press key 300, it is easy to distinguish if the assembly of the press key 300 is correct just by the colors of the components utilized. Similarly, when the assembled press key 300 is put into the electronic device 700 on the production assembly line, it may likewise to know if the two devices are match and correct in a swift manner.

Therefore, through the application of the modularized press key having the commonly used structure, the color distinctions between the elements may be utilized to provide the fool-proof and fault detection in facilitating the assembly and inspection of the press key depending on the actual requirements of the electronic product.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic device having a modularized press key, comprising:

a key cap, provided with a connection hole;

a switch, disposed opposite to said key cap; and an identification part and an extension part, one end of said identification part being connected to said connection hole, one end of said extension part being connected another end of said identification part in a specific direction, and another end of said extension part being pressed against said switch, thus achieving the various combinations of said key cap and said switch through the selection and utilization of various identification part and said matching extension part, wherein a recess slot is provided on a side of said identification part engaging said extension part, and a protrusion block is provided on a side of said extension part corresponding to said identification part, said protrusion block is used to match said recess slot, so that said extension part may engage said identification part in a specific direction.

2. The electronic device having a modularized press key as claimed in claim 1, wherein said recess slot is a square slot, and said protrusion block is a square block.

3. The electronic device having a modularized press key as claimed in claim 1, wherein said recess slot is a triangle slot, and said protrusion block is a triangle block.

4. The electronic device having a modularized press key as claimed in claim 1, wherein said extension part has a specific color, and is used to distinguish the various different combinations of said key cap and said switch.

5. The electronic device having a modularized press key as claimed in claim 1, wherein said identification part and said extension part are of the same specific color.

6. A modularized press key, utilized in an electronic device having a switch, comprising:

a key cap, provided with a connection hole, and being engaged to said electronic device and corresponding to said switch;

an identification part, being configured in said connection hole; and an extension part, being engaged to said identification part in a specific direction and being pressed against said switch, wherein a recess slot is provided on a side of said identification part engaging said extension part, and a protrusion block is provided on a side of said extension part corresponding to said identification part; said protrusion block is used to match said recess slot, so that said extension part may engage said identification part in a specific direction.

7. The modularized press key as claimed in claim 6, wherein said recess slot is a square slot, and said protrusion block is a square block.

8. The modularized press key as claimed in claim 6, wherein said recess slot is a triangle slot, and said protrusion block is a triangle block.

9. The modularized press key as claimed in claim 6, wherein said extension part has a specific color.

10. The modularized press key as claimed in claim 6, wherein said identification part has a specific color.

11. The modularized press key as claimed in claim 6, wherein said identification part and said extension part have a same specific color.

* * * * *